US005198717A

United States Patent [19]

Kogelschatz et al.

[11] Patent Number: 5,198,717

[45] Date of Patent: Mar. 30, 1993

[54] HIGH-POWER RADIATOR

[75] Inventors: Ulrich Kogelschatz, Hausen; Christoph von Arx, Olten, both of Switzerland

[73] Assignee: Asea Brown Boveri Ltd., Baden, Switzerland

[21] Appl. No.: 797,058

[22] Filed: Nov. 25, 1991

[30] Foreign Application Priority Data

Dec. 3, 1990 [EP] European Pat. Off. ..... 90123090.4

[51] Int. Cl.[5] ..... H01J 7/24

[52] U.S. Cl. ..... 313/17; 313/32; 165/47; 362/373

[58] Field of Search ..... 313/30, 32, 12, 44, 313/17; 315/112; 362/373; 165/47; 250/492.1

[56] References Cited

U.S. PATENT DOCUMENTS

| | | | |
|---|---|---|---|
| 2,342,412 | 2/1944 | Little | 313/12 |
| 4,837,484 | 6/1989 | Eliasson | 313/607 X |
| 4,983,881 | 1/1991 | Eliasson | 313/607 |
| 5,006,758 | 4/1991 | Gellert | 313/607 X |
| 5,013,959 | 5/1991 | Kogelschatz | 313/607 X |

FOREIGN PATENT DOCUMENTS

| | | |
|---|---|---|
| 0254111 | 1/1988 | European Pat. Off. . |
| 0324953 | 7/1989 | European Pat. Off. . |
| 0363832 | 4/1990 | European Pat. Off. . |
| 0385205 | 9/1990 | European Pat. Off. . |

OTHER PUBLICATIONS

Gesellschaft Deutscher Chemiker-Fachgruppe Photochemie, 10 Vortragstagung, 23-25 pps., GDCh, Wurzburg, FRG, Nov. 18-20, 1987, U. Kogelschatz, et al., "Neue UV- Und VUV-Excimerstrahler".

*Primary Examiner*—Alan Cohan

*Attorney, Agent, or Firm*—Oblon, Spivak, McClelland, Maier & Neustadt

[57] ABSTRACT

In the cooling of UV high-power radiators, the cooling of the inner electrodes (5) which are at high tension potential is critical insofar as it is necessary to use fully demineralized water or oil for this purpose. Since a cooling body (9) must in any event be employed for the external cooling, this cooling body is utilized at the same time as heat exchanger for the internal cooling.

6 Claims, 3 Drawing Sheets

HIGH-POWER RADIATOR

BACKGROUND OF THE INVENTION

1. Field of the Invention

The invention relates to a high-power radiator, especially for ultraviolet light, having a discharge space which is filled with a filling gas which emits radiation under discharge conditions, formed by the internal space of a cooled hollow body consisting of a material which is transparent to the radiation generated, with dielectric tubes which are spaced from the inner walls of the hollow body and which are provided with cooling channels and into which inner electrodes are embedded or inserted, with a high-tension source to feed the discharge.

Accordingly, the invention refers to a state of the art as is evident, for example, from the EP application bearing the publication number 0,363,832.

2. Discussion of Background

The industrial application of photochemical processes is greatly dependent upon the availability of suitable UV sources. The conventional UV radiators give low to medium UV intensities at a few discrete wavelengths, such as, for example, the low-pressure mercury lamps operating at 185 nm and especially at 254 nm. Really high UV power levels are achieved only from high-pressure lamps (Xe, Hg), which then however distribute their radiation over a greater wavelength range. The new excimer lasers made available certain new wavelengths for photochemical basic experiments. However, at the present time they are only in exceptional cases suitable for an industrial process, for reasons of cost.

A novel excimer radiator is described in the initially mentioned EP patent application, or also in the conference publication "Novel UV and VUV Excimer Radiators" by U. Kogelschatz and B. Eliasson, distributed at the 10th lecture meeting of the German Chemists Association, Photochemistry Technical Group, in Würzburg (FRG) on Nov. 18–20, 1987. This novel type of radiator is based on the principle that it is possible to generate excimer radiation even in silent electrical discharges, a type of discharge which is employed on an industrial scale in the production of ozone. In the current filaments of this discharge, which are present only for a short time (a few nanoseconds) inert gas atoms are excited by electron collision, which atoms react further to form excited molecular complexes (excimers). These excimers have a life of only a few nanoseconds, and on breaking up give off their binding energy in the form of radiation, the wavelength range of which may be in the UVA, UVB, UVC and VUV or also in the visible spectral range, depending upon the composition of the filling gas.

In very recent times the search for such high-power radiators has intensified, since the particular properties of the radiator have opened up many new areas of application in chemical and physical process technology, in the graphics industry, for coatings etc.

In addition to an optimal design of the radiator with regard to dielectric material, slit width, pressure, temperature and composition of the gas employed, the effective cooling of the radiator is also of decisive importance with regard to its commercial application. In the case of the known radiators, the outer electrode which is at earth potential is regularly cooled. An optional feature is also a cooling of the inner electrode (which is at high-tension potential), in this connection it merely being stated that a liquid or gaseous coolant is passed through the hollow inner electrode. On account of the potential conditions, when liquid cooling is employed it is necessary to use a coolant which exhibits a very low conductance, e.g. fully demineralized water, or oil. In addition, the cooling of the inner electrode must take place in a closed circuit, on economic grounds.

SUMMARY OF THE INVENTION

Proceeding from the prior art, the object of the invention is to provide a high-power radiator, especially for UV or VUV light, which can be cooled in a technically simple and economic manner.

In order to achieve this object with a high-power radiator of the initially mentioned type, it is provided according to the invention that the hollow body is in thermal contact with a cooling body in which cooling channels () are provided, which are connected to the cooling channels of the dielectric tubes and form a closed coolant circuit, and in that a cooling liquid having a low electrical conductance can be passed through these cooling channels.

In this manner, the cooling device which is in any event necessary for the (outer) hollow body forms the heat exchanger for the coolant circuit of the dielectric tubes. The hollow body can be cooled by conventional tap water. Thus, there is a saving of large quantities of costly fully demineralized or distilled water, or the need for an additional circulatory cooling system for the dielectric tubes is eliminated.

The invention is explained in greater detail hereinbelow with reference to illustrative embodiments.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
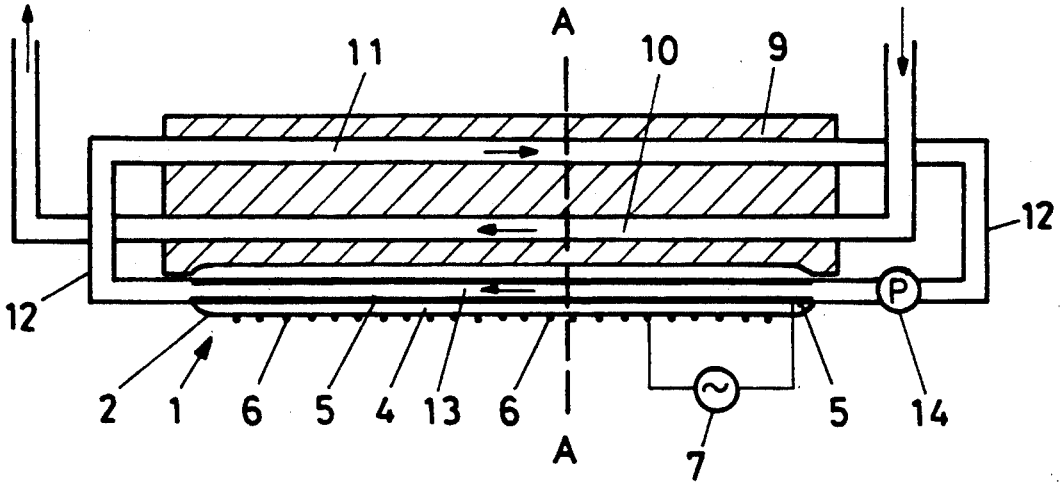
FIG. 1 shows a longitudinal cross section through the one UV high-power radiator together with a diagrammatic representation of the two cooling circuits.
Figure 2:
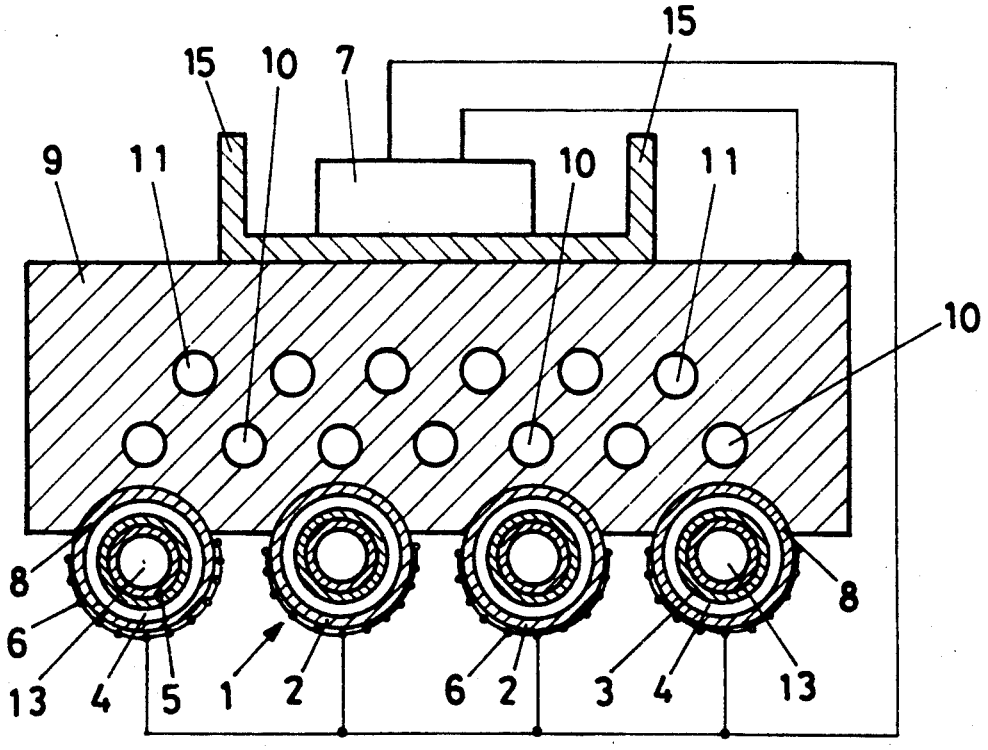
FIG. 2 shows an enlarged and more detailed cross-sectional representation of the UV high-power radiator according to FIG. 1 along line AA thereof in cross section, in this case the cooling body additionally being employed as carrier and cooler for the electrical feeding of the radiator.

Referring now to the drawings, wherein like reference numerals designate identical or corresponding parts throughout the several views, in FIGS. 1 and 2 the high-power radiator consists, in the case of the present example, of four cylindrical individual radiators 1, the construction of which is known per se. A dielectric tube 3 is disposed in an outer quartz tube 2, spaced from the latter. The annular space between the two tubes forms the discharge space 4 of the radiator. The inner wall of the dielectric tube 3 is provided with a metal- coating 5 (shown in FIG. 2 with an exaggerated thickness), which forms the inner electrode cf the radiator. Alternatively, it is also possible to use in place of a metal coating 5, metal tubes which are covered with a dielectric coating, e.g. ceramic-based. The outer electrode of the radiator consists of a wire grid or a wire gauze 6, which extends over the entire length and a major part of the outer periphery of the outer quartz tube 2. A high-tension source 7 to feed the discharge is connected to this outer electrode and the inner electrode (FIG. 1).

The interior of the quartz tube 1 is filled with a filling gas which emits radiation under discharge conditions, e.g. mercury, inert gas, an inert gas/metal vapor mixture, an inert gas/halogen mixture, possibly with the use of an additional further inert gas, preferably Ar, He or Ne, as buffer gas.

As is evident from the enlarged cross-sectional view according to FIG. 2, the four individual radiators 1 are situated in grooves 8 on the broad side of a cooling body 9 consisting of material of good thermal conductivity. These grooves 8 are matched in cross section to the outer contour of the outer quartz tube 2. The cooling body 9 is provided with two groups of cooling channels 10 and 11, which extend in the longitudinal direction of the grooves. The cooling channels 10 of the first group lead to an outer cooling circuit (not shown in any further detail). In the simplest case, conventional tap water flows through them in the direction of the arrow. The cooling channels 11 of the other group are connected via connecting lines 12 and suitable connection fittings (not shown) to the internal space 13 of the dielectric tubes 3. A pump 14 provides the circulation of a cooling liquid with low electrical conductivity, e.g. demineralized water or oil, in the cooling circuit which has just been described. In this manner, the cooling body 9 acts as heat exchanger between the primary cooling system (cooling channels 10) and the secondary cooling system (cooling channels 11, connecting lines 12, internal space 13 of the dielectric tubes 3, pump 14). The potential separation is ensured by the cooling liquid in the secondary cooling system, which liquid has virtually zero electrical conductivity.

In principle, the high-tension source 7 corresponds to those of the type employed to feed ozone generators. Typically, it delivers an adjustable alternating voltage in the order of magnitude of several hundred volts to 20,000 volts at frequencies in the range of industrial alternating current up to a few MHz, depending upon the electrode geometry, the pressure in the discharge space and the composition of the filling gas. In the UV high-power radiators under discussion here, the frequencies of the supply voltage are as a rule considerably above industrial alternating voltage; they may reach several hundred kilohertz. A high-tension source 7 suitable for this purpose is as a rule constructed in accordance with the principle of a combinatorial circuit component and accordingly includes electrical and electronic components which must be cooled and accordingly are mounted on profiled cooling sections. According to a further development of the invention, it is now provided that the cooling body 9, which is in any event necessary for the cooling of the radiator, is also utilized for the cooling of the components of the high-tension source 7. This is illustrated in FIG. 2 in that the profiled cooling sections 15 of the high-tension source 7 are secured directly on the underside of the cooling body 9 of the radiator. In this manner, the fan in the high-tension source 7 can be dispensed with. As a result of the spatial proximity of source and load, the cost of the electromagnetic screening is lower. The construction of the entire irradiation device may be designed on an extremely modular basis.

Figure 3:
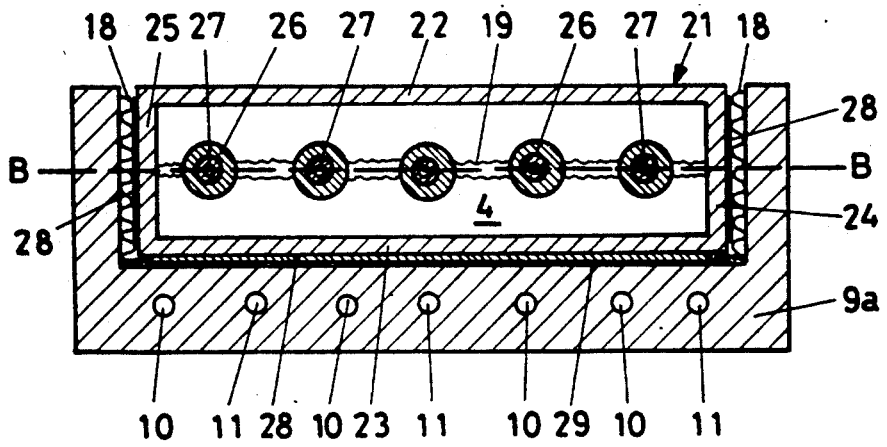
FIG. 3 shows an embodiment with a different type of radiator.

In addition to the above described individual radiators having a cylindrical cross section, it is of course possible also to provide surface radiators, e.g. according to EP-A-0,254,111, with a primary and a secondary cooling circuit. Furthermore, UV high-power radiators having an entirely different geometry may be equipped with the cooling concept according to the invention. This is explained in greater detail herein below with reference to FIG. 3.

In this UV high-power radiator, five dielectric tubes 26 with hollow inner electrodes 27 are disposed in a quartz tube 21 with a rectangular cross section having the broad sides 22, 23 and the narrow sides 24, 25. The dielectric tubes 26 are spaced from one another and also from the walls of the quartz tube 21. The dielectric tubes 26 are, for example, small quartz tubes, and the inner electrodes 27 are small metal tubes. Instead of this, it is also possible to use a metal tube encased with dielectric material.

The two narrow sides 24, 25 and one of the broad sides 23 of the quartz tube 21 are each externally provided with an aluminum coating 28. The three coatings may, but need not, be electrically insulated from one another. The aluminum coating 28 is preferably vaporized, flame-sprayed, plasma-sprayed or sputtered, and serves as reflector. The aluminum coatings 28 on the narrow sides 24, 25 of the quartz tube 21 may moreover serve as additional outer electrodes for a supply using a high-tension source 7 having an output which is ground-symmetric.

Figure 4:
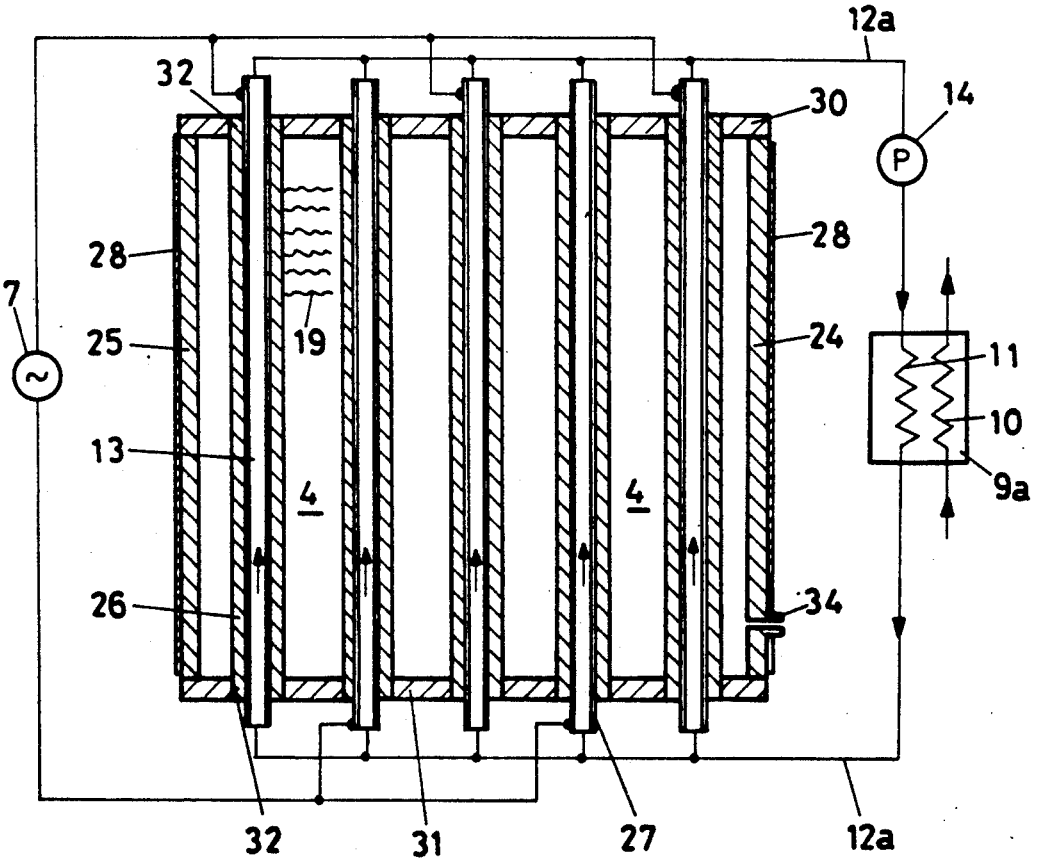
FIG. 4 shows a cross section through the radiator according to FIG. 3 along line BB thereof.

As may be seen from FIG. 4, the quartz tube 21 is sealed at its two end faces by plates 30, 31 consisting of insulating material. These plates are, for example, adhesively bonded onto the end faces or, in the case of quartz or glass plates, melted together with said end faces. The plates 30, 31 are provided with passages 32 into which the dielectric tubes 26 are inserted and secured and sealed therein. Via a filling connection 34, it is possible to evacuate the internal space of the quartz tube 1 and then to fill that space with a filling gas.

As may be seen from FIG. 4, the electrical supply to the radiator is provided from a source server of alternating voltage 7 in such a manner that adjacent inner electrodes (small metal tubes 27) are alternately connected to the source server of alternating voltage 7. When a voltage is present, a multiplicity of discharge channels 19 are formed between adjacent dielectric tubes 26, which give off the UV light, which then penetrates to the outside through the transparent broad side 22 of the quartz tube 21. The proposed supply permits the use of a high-tension source 7 having an output which is ground-symmetric. The cooling body 9*a* can then be set to earth potential.

In order to provide the external cooling of the radiator, the quartz tube 21 is inserted into a cooling body 9*a* having a U-shaped cross section. Lateral braided bands 18 provide the electrical contact between the aluminum coating 28 and the limbs of the cooling body 9*a*. An optional thermally conductive paste 29 between the lower broad side 23 of the quartz tube 21 is employed to improve the transfer of heat. In the base portion of the cooling body 9*a*, a multiplicity of cooling channels 10, 11 are provided, extending in the longitudinal direction of the cooling body. The one group, which is designated by 10, is employed, in a manner similar to the embodiment according to FIGS. 1 and 2 as the primary cooling circuit and, for example, conventional tap water flows through this. The other group, which is designated by 11, is connected to all small metal tubes 27, which are hydraulically connected in series or in parallel, via suitable connecting lines 12*a* and connection fittings (not shown). The pump 14 provides the circulation of a cooling liquid having a very low electrical conductance in this secondary cooling circuit. In this case, the cooling body 9*a* is employed as heat exchanger between the two coolant circuits.

In the illustrative embodiments described herein above, two groups of cooling channels 10, 11 were provided in each case in the cooling body of the radiator. It is, of course, within the scope of the invention also to design the primary cooling circuit in a different manner. Thus, for example, the cooling body may dip partially into a coolant or may be provided with large-area cooling fins, even subjected to forced cooling with air. In the case of such alternatives, there is no need for any alteration of the secondary cooling circuit for the radiator.

Figure 5:
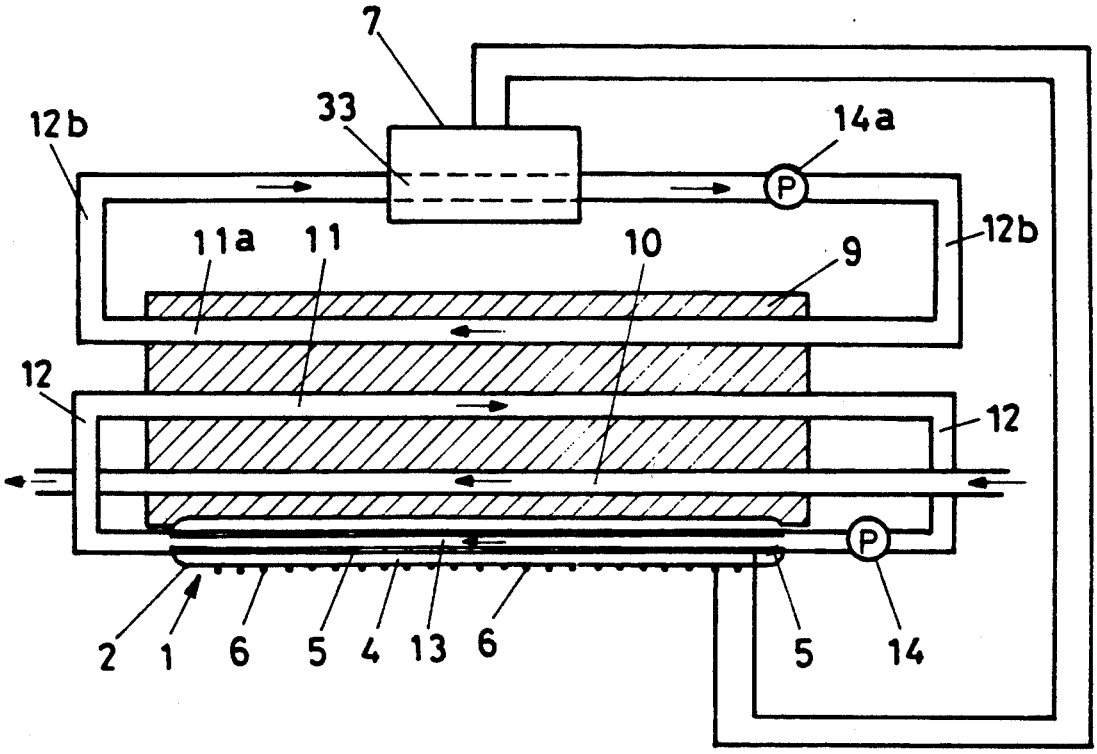
FIG. 5 shows a longitudinal cross section through the one UV high-power radiator in a diagrammatic representation with cooling circuits for the radiator and the high-tension source.

A further alternative is diagrammatically represented in FIG. 5. In this case, the cooling body 9 is employed both as heat exchanger for the internal cooling of the radiator and also as heat exchanger for a further cooling circuit to cool the high-tension source 7. For this purpose, additional channels 11*a* are provided in the cooling body 9, which additional channels are connected to cooling channels 33 in the high-tension source 7 via connecting lines 12*b* and a further pump 14*a*.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A high-power radiator for radiating ultraviolet light, comprising:

at least one hollow body built of a material which is transparent to ultraviolet radiation;

at least one outer electrode, which is transparent to ultraviolet radiation, disposed outside the hollow body;

at least one first dielectric tube, spaced from an inner wall of the hollow body and disposed inside the hollow body, the first dielectric tube provided with an inner electrode and with a cooling channel;

wherein a discharge space filled with a filler gas which emits ultraviolet radiation upon discharge conditions is formed by a space between the inner wall of the hollow body and an outer wall of the first dielectric tube;

a high-voltage source to feed the discharge, which is connected to the outer and inner electrodes;

a cooling body including a cooling channel connected to the cooling channel of the dielectric tube to form a closed coolant circuit; and the cooling body having a groove in which said hollow body is saturated in thermal contact with said cooling body, the hollow body being secured to the cooling body;

wherein a cooling liquid having a low electrical conductance can be passed through said cooling channels.

2. The high-power radiation as claimed in claim 1, comprising:

plural of said hollow bodies each comprising second dielectric tubes situated in grooves of the said cooling body, said grooves being matched in cross section to outer contours of the second dielectric tubes, each second dielectric tube having a first dielectric tube disposed therein, and defining a discharge space.

3. The high-power radiator as claimed in claim 1, wherein the hollow body comprises a dielectric tube having a rectangular shape, and plural of first dielectric tube are situated in an inner space of said rectangular shaped dielectric tube.

4. The high-power radiator as claimed in claim 1, wherein the high-voltage source includes electric or electronic components at least some of which are disposed on the cooling body and have a good thermal conductive connection with the cooling body.

5. The high-power radiator as claimed in claim 1, wherein the high-voltage source comprises a cooling device which is connected to cooling channels in the cooling body.

6. A high-power radiator for radiating ultraviolet light, comprising:

a hollow body built of the material which is transparent to ultraviolet radiation;

plural dielectric tubes disposed within said hollow body and penetrating walls of the hollow body, said dielectric tubes each provided with an inner electrode and with a cooling channel;

a high-voltage source applied across the electrodes of adjacent of said dielectric tubes to produce a discharge in a filler gas disposed in a discharge space between the dielectric tubes;

a cooling body including cooling channels connected to the cooling channels of said dielectric tubes to form a closed coolant circuit; and the cooling body having a groove in which said hollow body is situated in thermal contact with the cooling body, the hollow body being secured to the cooling body;

wherein in a cooling liquid having a low electrical conductance can be passed through said cooling channels.

* * * * *